United States Patent [19]

Trop

[11] 4,437,790

[45] Mar. 20, 1984

[54] BUOYANCY COMPENSATOR

[76] Inventor: Timothy N. Trop, 139 Elmwood Dr., Naperville, Ill. 60540

[21] Appl. No.: 423,221

[22] Filed: Sep. 24, 1982

[51] Int. Cl.[3] ..... B63C 11/18; B63C 11/02

[52] U.S. Cl. ..... 405/186; 114/315; 441/94

[58] Field of Search ..... 405/186, 187; 441/90–101; 114/315, 331

[56] References Cited

U.S. PATENT DOCUMENTS

| | | | |
|---|---|---|---|
| 3,727,250 | 4/1973 | Koehn et al. | 405/186 |
| 3,820,348 | 6/1974 | Fast | 405/186 |
| 3,877,098 | 4/1975 | Braly | 405/186 |
| 3,964,266 | 6/1976 | Bartlett | 114/315 |
| 4,016,616 | 4/1977 | Walters | 114/315 |
| 4,114,389 | 9/1978 | Bohmrich et al. | 441/96 |
| 4,379,656 | 4/1983 | Darling | 405/186 |

FOREIGN PATENT DOCUMENTS

| | | | |
|---|---|---|---|
| 1047843 | 9/1975 | Canada | 441/94 |

*Primary Examiner*—Dennis L. Taylor
*Attorney, Agent, or Firm*—Timothy N. Trop

[57] ABSTRACT

A buoyancy compensator in the form of an air inflatable vest wearable generally about the user's chest and having a back portion encircling the user's back or neck, includes an air pressure release mechanism on the vest back portion. The air pressure release mechanism may include a tube arranged to extend upwardly when the user is oriented in the normal prone swimming position. A valve located near the upper, open end of the tube may be operable by the user through a remote valve operator to release air pressure from the compensator enclosure. The remote valve operator may be positioned on the air inflation hose adjacent to the air inflation hose valve to enable one handed inflation and delfation. In one advantageous embodiment the remote valve operator is connected to the valve by a strand encased within a sleeve so that manipulation of the operator opens the valve to release air pressure. The strand may be arranged such that when the user attempts to exhaust the air from the buoyancy compensator by extending the inflation hose away from the user and generally in an upward direction while opening the inflation hose valve, in a conventional fashion, the valve in the tube is also automatically opened to ensure that any air pocket in the back portion of the buoyancy compensator is exhausted.

21 Claims, 7 Drawing Figures

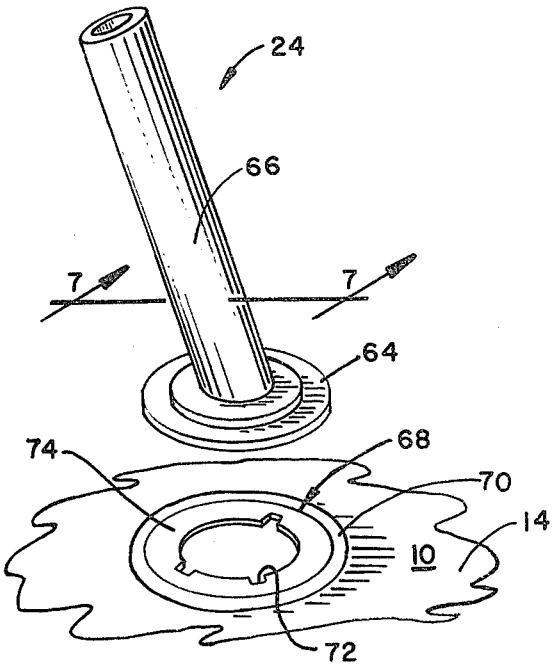
FIG. 5
FIG. 6
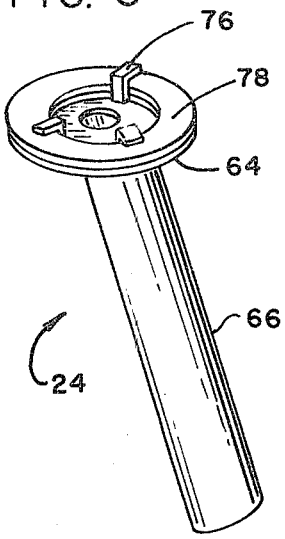
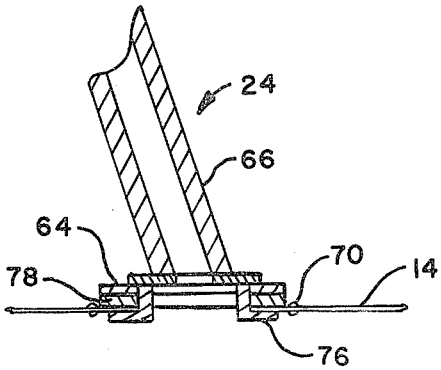
FIG. 7

BUOYANCY COMPENSATOR

BACKGROUND OF THE INVENTION

1. Field of the Invention

The present invention relates generally to scuba diving equipment and particularly to an improved buoyancy compensator.

2. Brief Description of the Background Art

The buoyancy compensator is an essential article of scuba diving equipment, allowing the scuba diver to maintain neutral buoyancy underwater, to achieve a feeling of freedom and to permit exact control over the diver's position in the water. One widely utilized buoyancy compensator, sometimes called "a horse collar B.C. vest," includes a vest portion and a connected neck encircling portion, both of which are air inflatable. The user inflates the buoyancy compensator through a flexible air inflation hose, connected to the front of the vest, using a valved mouthpiece. The mouthpiece valve may be operated to permit oral or power inflation of the buoyancy compensator.

While currently marketed buoyancy compensators are capable of extremely safe and efficient operation, they suffer from certain deficiencies. Particularly, pockets of air commonly collect in the region behind the user's neck or generally in the back regions of the vest. The air pockets often are difficult to discover, since they are not visible to the user, and thus a user may begin his or her ascent to the surface without realizing that a relatively large quantity of air is still held within the buoyancy compensator. This presents a safety hazard since as the diver ascends the air expands at a rate that could produce an uncontrolled ascent potentially causing the "bends." The diver normally attempts to prevent such an occurrence by reaching around and squeezing any air out of the neck or back portion and by forcefully pulling the inflation hose upwardly and away in order to encourage all the air to escape. However, both of these techniques are not only awkward but they are not always effective. In addition the presence of such an air pocket may interfere with the diver's ability to precisely control his or her buoyancy. Thus, current diving equipment provides no automatic means for exhausting any such air pocket and no mechanism for controlling the effects of these air pockets.

SUMMARY OF THE INVENTION

It is a primary object of the present invention to provide a more effective mechanism for exhausting the air from a buoyancy compensator at depth.

It is another object of the present invention to provide an automatic mechanism for removing any air from the neck or back portion of a buoyancy compensator.

It is yet another object of the present invention to provide a remotely actuable means, situated at the end of the air inflation hose, which enables air to be easily exhausted from the neck or back portion of a buoyancy compensator.

These and other objects of the present invention are achieved by a buoyancy compensator that includes an air containing enclosure with a vest portion adapted to be worn on the user's chest and a back portion adapted to be worn against the user's back. An inflation means allows the user to inflate the enclosure. The inflation means includes an elongated hose in fluid communication with the interior of the enclosure. The inflation means further includes a manually operable valve for controlling the air flow through the hose. A valved exhaust means communicates with the interior of the back portion of the enclosure and includes a tube arranged to extend upwardly away from the enclosure when the user is in a downwardly facing prone position. The exhaust means further includes a valve located within the tube, operable to release air under pressure from the enclosure.

BRIEF DESCRIPTION OF THE DRAWINGS

FIG. 5 is a partial, enlarged, exploded perspective view of the exhaust tube shown in FIG. 1;

FIG. 6 is a partial, bottom elevational view of the exhaust tube shown in FIG. 5; and FIG. 7 is a partial, cross-sectional view taken generally along the line 7—7 in FIG. 5.

DESCRIPTION OF THE PREFERRED EMBODIMENT

Figure 1:
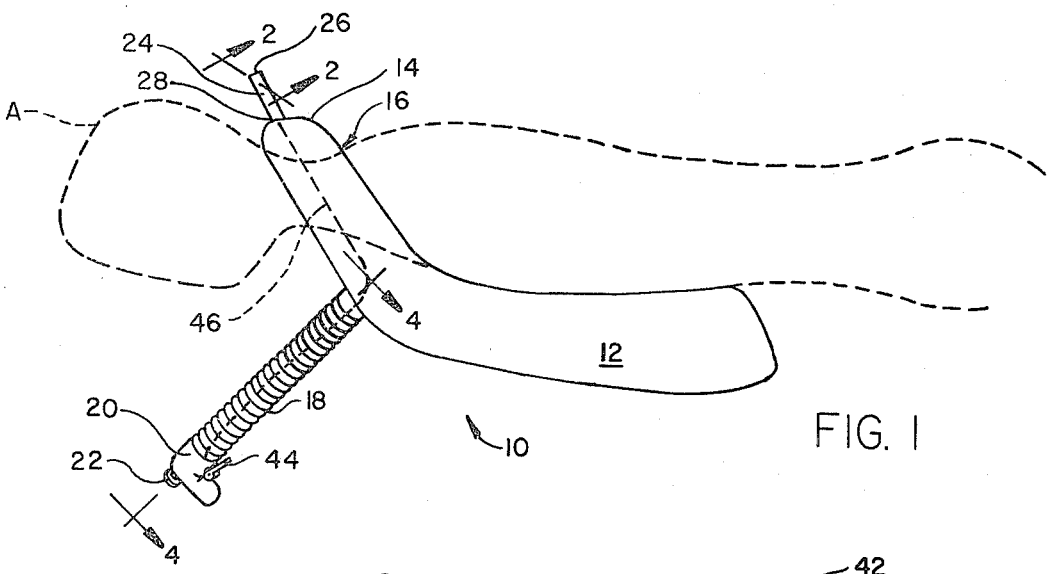
FIG. 1 is a perspective view of one embodiment of the present invention in use.

Referring to the drawing wherein like reference characters are used for like parts throughout the several views, a buoyancy compensator 10, shown in FIG. 1, includes an air retaining chest portion 12, arranged to be situated against the user's chest, and an air retaining back portion 14, connected to the chest portion 12 but arranged to encircle the user's back, and particularly, in the embodiment illustrated, the user's neck. In a conventional fashion, the buoyancy compensator 10 includes a number of straps and buckles (not shown) to secure the buoyancy compensator 10 to the user's body. In use the user extends his or her head, indicated as "A" in FIG. 1, through the opening 16 so that the buoyancy compensator 10 is worn broadly in the form of a vest. A flexible, accordian-like inflation hose 18 extends away from the chest portion 12 of the buoyancy compensator 10 and includes an L-shaped inflation handle 20. The handle 20 includes a pushbutton valve operator 22 which operates an internal valve (not shown) to allow air flow into or out of the inflation hose 18 and the remainder of the compensator 10 in a conventional manner.

Although the buoyancy compensator is illustrated herein as a "horse collar" type of compensator, other styles may be used as well. While the buoyancy compensator 10 has been illustrated as an orally inflatable buoyancy compensator, provision for power inflation can also be provided.

Figure 2:
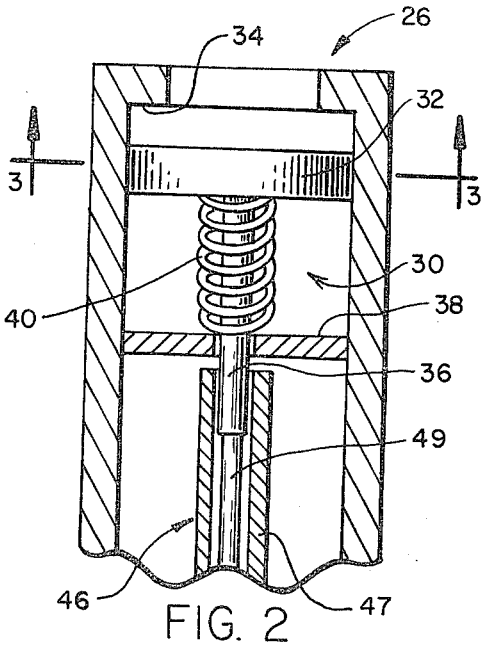
FIG. 2 is an enlarged, partial, cross-sectional view taken generally along the line 2—2 in FIG. 1.
Figure 3:
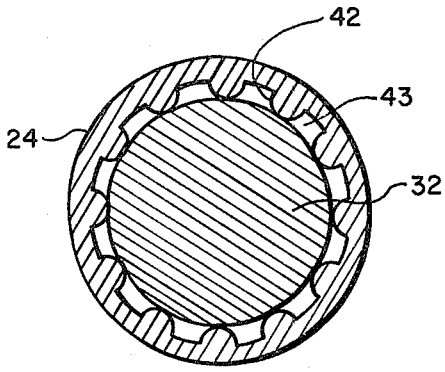
FIG. 3 is a cross-sectional view taken generally along the line 3—3 in FIG. 2.

An exhaust tube 24 is situated on the back portion 14 in fluid communication with the interior of the buoyancy compensator 10. The exhaust tube 24 is arranged so that when the buoyancy compensator 10 is in use, with the diver in the prone, downwardly facing swimming position illustrated, the exhaust tube 24 extends generally upwardly. Advantageously, the tube 24 also extends forwardly, so that it also has an upward orientation when the user is in an upstanding position and so that entanglement with the user's air tank is avoided. The exhaust tube 24, conveniently made of somewhat flexible tubular stock, such as rubber or the like, inclined at about 45° to the user's height, includes an open free end 26 and an opposite end 28 which communicates with the interior of the buoyancy compensator 10. The open free end 26, shown in FIG. 2, includes an internal spring biased valve 30.

The valve 30 includes a sliding piston element 32, normally pressed against a seat 34 to sealingly close the valve 30 against the ambient water pressure bearing on the exposed portion of the piston element 32. The piston element 32 includes a rod 36 which slides through a crosspiece 38 secured at diametrically opposite points to the interior wall of the tube 24. A coil spring 40, encircling the rod 36, is trapped between the upper surface of a crosspiece 38 and the lower surface of the sliding piston element 32. Thus the coil spring 40 normally biases the piston 32 against its seat 34, closing the valve 30 against the force of the ambient water pressure. The overhanging arrangement of the seat 34 causes the effective force of the water pressure to increase once the valve 30 is slightly opened, since the exposed portion of the piston element 32 is increased. The internal surface of the tube 24 in the region adjacent the sliding piston 32 includes a plurality of axially aligned, radially inwardly extending ribs 42 to enable air to exit from the buoyancy compensator 10, by way of gaps 43, to the surrounding environment when the sliding piston 32 is pulled away from the seat 34.

Figure 4:
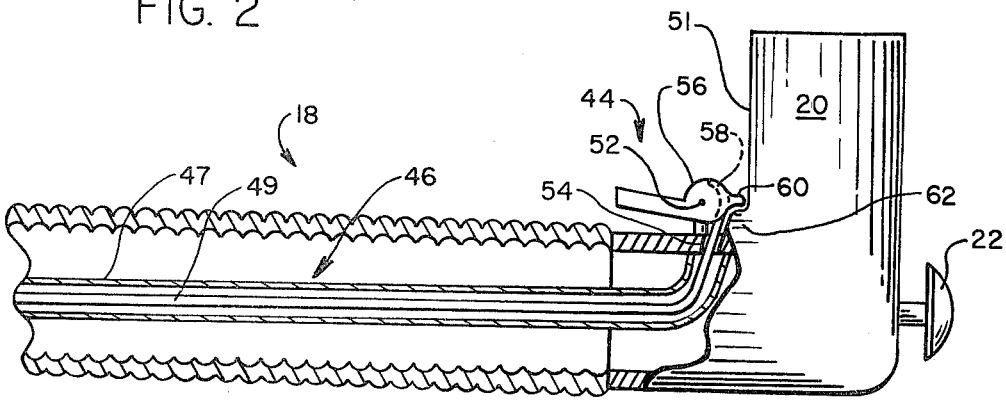
FIG. 4 is a partial, enlarged cross-sectional view taken generally along the line 4—4 in FIG. 1.

The piston rod 36 is connected to a manual operator 44 mounted on the inflation handle 20, by a flexible strand 46. As indicated in FIGS. 1 and 4, the strand 46 runs from the valve 30 through the tube 24 and the back portion 14 into the inflation hose 18 and eventually connects to the operator 44. The flexible strand 46 may take a variety of forms including a nylon string, a stainless steel wire, or the like, but advantageously the strand 46 is in the form of a cable made up of an encircling flexible sleeve 47 and an internal, conveniently stainless steel, metallic wire 49 that slides relative to the sleeve 47. On one end in the illustrated embodiment, the wire 49 is attached to the free end of the rod 36 while the sleeve 47 freely encircles the rod 36. The operator 44 is pivotally mounted on the inside corner surface 51 of the oral inflation handle 20 so that the user may operate the inflation pushbutton valve operator 22 with the thumb while operating the operator 44 with the forefinger of the same hand.

Since the wire 49 is wrapped around the pivot point 52 of the operator 44, pivoting the operator 44 causes the rod 36 to be pulled downwardly, opening the valve 30 as the wire 49 is pulled through the opening 54 and is wrapped about the operator 44. Conveniently, the generally circular portion 56 of the operator 44 includes a peripheral groove 58 to receive the wire 49. The sleeve 47 may be sealingly attached to the inside surface of the oral inflation handle 20.

Advantageously the length of the strand 46 is such that when the oral inflation handle 20 is extended outwardly to the length of the user's arm and stretched upwardly in the conventional fashion when it is desired to exhaust the air from the buoyancy compensator 10, for example, preparatory to ascent, the valve 30 is automatically operated without the necessity of manually pivoting the operator 44. This action is facilitated by the tab 60 on the portion 56 which interacts with the stop 62 on the handle 20. The stop 62 and tab 60 prevent reverse rotation of the operator 44, thereby causing the rod 36 to be pulled downwardly by the strand 46, opening the valve 30 when the hose 18 is stretched outwardly.

The exhaust tube 24, as shown in FIGS. 5–7, conveniently includes a flanged base 64 and an angled, upstanding tubular portion 66. The base 64 removably connects the exhaust tube 24 to the rest of the buoyancy compensator 10. The back portion 14 includes an attachment ring 68 with a crimp or seal 70 which secures the ring 68 to the buoyancy compensator 10. A plurality of radial slots 72, arranged to extend inwardly to a point spaced slightly from the seal 70, are defined within an annulus 74. The slots 72 are irregularly angularly spaced with respect to one another. As shown in FIG. 6, the base 64 of the exhaust tube 24 includes a plurality of downwardly and outwardly extending L-shaped prongs 76 arranged in the same relative angular orientation as the slots 72. The bottom surface of the base 64 also includes a resilient annulus 78 situated under the prongs 76.

Thus when the exhaust tube 24 is inserted into the ring 68, the prongs 76 pass through the slots 72 therein. When the exhaust tube 24 is then rotated, the prongs 76 are arranged beneath and engage the annulus 74 while the resilient annulus 78 is compressed against the annulus 74. This is accomplished by making the length of the prongs 76, measured in the direction extending directly outwardly from the base 64, somewhat less than the thickness of the annuli 74 and 78. The compression of the resilient annulus 78 provides an air and water tight seal between the exhaust tube 24 and the buoyancy compensator 10, as shown in FIG. 7. The removability of the tube 24 advantageously facilitates cleaning and repair and permits the user to elect whether or not to use the tube 24. A closure plug (not shown) with prongs 76 may be provided to close the attachment ring 68 opening when the tube 24 is not used.

The present invention provides a more effective and more easily operated mechanism for exhausting the air from a buoyancy compensator. The positioning of the tube 24 over the diver insures that a substantial pressure differential exists between the tube open free end 26 and the region located within the buoyancy compensator 10, when the valve 30 is operated to its open position. This encourages the complete exhaustion of the air within the buoyancy compensator 10. However, the user still has the option to exhaust air in the conventional fashion through the inflation hose 18. The necessity of the awkward stretching of the inflation hose 18 outwardly and over the diver in order to fully exhaust the air from the buoyancy compensator 10 preparatory to and during ascent is thereby avoided. Since this technique is often not fully successful, the complete exhaustion of air from the buoyancy compensator preparatory to ascent may be desirably accomplished through the use of the present invention which thereby achieves significant safety advantages. In addition, since the exhaust tube 24 valve 30 is automatically operated when the inflation hose 18 is fully extended, all of the air is automatically exhausted from the buoyancy compensator 10 prior to ascent without the necessity of operating the valve 30 separately. Since good diving technique normally requires the diver to fully extend the inflation hose upon ascent, this procedure, when used with the present invention, ensures drainage of air through two openings, improving the extent and effectiveness of air exhaust from the buoyancy compensator. In this way significant safety, convenience and effectiveness advantages are achieved by the present invention.

While the present invention has been described with respect to a single preferred embodiment, those skilled in the art will appreciate a number of modifications and it is intended within the appended claims to cover all such modifications as are within the true spirit and scope of the present invention.

What is claimed and desired to be secured by Letters Patent of the United States is:

1. A buoyancy compensator, comprising:

an enclosure for containing air including a vest portion adapted to be worn on the user's chest and a back portion adapted to be encircle the back of the user;

an inflation means for allowing the user to inflate said enclosure, said inflation means including an elongate hose in fluid communication with the interior of said enclosure, said inflation means further including a manually operable valve for controlling the fluid flow through said hose;

an exhaust means for exhausting air from said enclosure, mounted on said enclosure and communicating with the interior of said enclosure, said exhaust means including a valve operable to release air under pressure from said enclosure; and means for automatically opening said exhaust means valve when said inflation hose is extended forcefully away from the user.

2. The compensator of claim 1 including a remote operator means for manually opening and closing said exhaust means valve, said exhaust means being mounted on said back portion and arranged to face upwardly when the user is in a downwardly facing prone position.

3. The compensator of claim 2 including an elongate strand connecting said exhaust means valve to the end of said elongate hose, said elongate hose including a manual operator for varying the tension on such strand in order to open and close said exhaust means valve.

4. The compensator of claim 3 wherein said strand is in the form of a sheathed cable, said sheathed cable connected on one end to said exhaust means valve and on the other end to said inflation hose such that the tension of said cable may be varied to open and close said valve from a point remote from said valve.

5. The compensator of claim 1 wherein said opening means includes a strand connected from said exhaust means valve to said hose.

6. The compensator of claim 2 wherein said inflation hose includes a free end and said inflation means valve being located adjacent said free end, said remote operator means being positioned adjacent said inflation means valve.

7. The compensator of claim 6 wherein said remote operator means includes a pivotable lever arm pivotal toward said inflation hose to open said exhaust means valve.

8. The compensator of claim 1 wherein said exhaust means includes an upwardly extending tube connected to said back portion.

9. The compensator of claim 8 wherein said exhaust means tube and valve are removable from the remainder of said enclosure.

10. The compensator of claim 9 wherein said exhaust means tube and valve are removably, rotatably connectable to said enclosure.

11. The compensator of claim 10 wherein said exhaust means valve includes a reciprocating piston and spring, said piston normally biased by said spring to a seated closed position.

12. The compensator of claim 8 wherein said tube extends forwardly and upwardly away from said back portion at about 45°.

13. The compensator of claim 8 wherein said tube includes a free end and said exhaust means valve is located in said tube adjacent said free end.

14. The compensator of claim 13 including a remote operator means, mounted on the free end of said hose, for manually opening and closing said exhaust means valve.

15. The compensator of claim 1 including manually operable means for permitting selective operation of said inflation means valve and said exhaust means valve with one hand.

16. The compensator of claim 1 wherein said buoyancy compensator is a horse collar style compensator with said back portion defining a head opening and arranged to encircle the user's neck.

17. A buoyancy compensator, comprising:

an enclosure for containing air including a vest portion adapted to be worn on the user's chest and a back portion adapted to encircle the back of the user;

an inflation means for allowing the user to inflate said enclosure, said inflation means including an elongate hose in fluid communication with the interior of said enclosure, said inflation means further including a manually operable valve for controlling the fluid flow through said hose;

an exhaust means for exhausting air from said enclosure, mounted on said back portion and communicating with interior of said enclosure, said exhaust means including a valve operable to release air under pressure from said enclosure;

a remote operator means for manually opening and closing said exhaust means valve; and an elongate strand connecting said exhaust means valve to the end of said elongate hose, said elongate hose including a manual operator for varying the tension on said strand in order to open and close said exhaust means valve.

18. The compensator of claim 17 wherein said exhaust means is arranged to face upwardly when the user is in a downwardly facing prone position.

19. A buoyancy compensator, comprising:

an enclosure for containing air including a vest portion adapted to be worn on the user's chest and a back portion adapted to encircle the back of the user;

an inflation means for allowing the user to inflate said enclosure, said inflation means including an elongate hose in fluid communication with the interior of said enclosure, said inflation means further including a manually operable valve for controlling the fluid flow through said hose;

an exhaust means for exhausting air from said enclosure, mounted on said back portion and communicating with the interior of said enclosure, said exhaust means including a valve operable to release air under pressure from said enclosure; and a remote operator means for manually opening and closing said exhaust means valve; and said inflation hose including a free end and said inflation means valve being located adjacent said free end, said remote operator means being positioned adjacent said inflation means valve.

20. The compensator of claim 19 wherein said remote operator means includes a pivotable lever arm pivotal toward said inflation hose to open said exhaust means valve.

21. A buoyancy compensator, comprising:

an enclosure for containing air including a vest portion adapted to be worn on the user's chest and back portion adapted to encircle the back of the user;

an inflation means for allowing the user to inflate said enclosure, said inflation means including an elongate hose in fluid communication with the interior of said enclosure, said inflation means further including a manually operable valve for controlling the fluid flow through said hose;

an exhaust means for exhausting air from said enclosure, mounted on said back portion and communicating with the interior of said enclosure, said exhaust means including a valve operable to release air under pressure from said enclosure, said exhaust means further including an upwardly extending tube connected to said back portion, said tube including a free end and said exhaust means valve being located in said tube adjacent said free end; and a remote operator means, mounted on the free end of said hose, for manually opening and closing said exhaust means valve.

* * * * *